United States Patent [19]

Van Horn

[11] Patent Number: 4,591,420

[45] Date of Patent: May 27, 1986

[54] METHOD AND APPARATUS FOR IMPROVING ELECTROPLATING AND PAINTING RACKS

[76] Inventor: Samuel L. Van Horn, 2270 S. High St., Columbus, Ohio 43207

[21] Appl. No.: 656,253

[22] Filed: Oct. 1, 1984

[51] Int. Cl.[4] ..... C25D 17/04; A47H 1/16

[52] U.S. Cl. ..... 204/297 W; 248/302; 211/106; 211/112; 211/119; 211/181

[58] Field of Search ..... 204/297 W; 248/302; 211/106, 112, 119, 181

[56] References Cited

U.S. PATENT DOCUMENTS

| | | | |
|---|---|---|---|
| 1,707,557 | 4/1929 | Leap | 248/302 |
| 2,258,391 | 10/1941 | Novitsky | 204/297 W |
| 2,512,554 | 6/1950 | Schneider | 204/297 W |
| 3,866,809 | 2/1975 | James | 211/119 |
| 4,243,146 | 1/1981 | Davitz | 204/297 W |

*Primary Examiner*—John F. Niebling

*Attorney, Agent, or Firm*—John L. Shailer

[57] ABSTRACT

A retaining tip for releasable attachment to a rod of circular cross-section in which two arms are attached to one another at one end of each by a circular wound helical spring. The other end of each arm is configured to retain parts or objects which are to be processed. The circular spring may be mechanically opened to receive the circular rod and then released to frictionally engage the rod. Clips utilizing a similar design are used to join cross members to build up an electroplating fixture.

8 Claims, 3 Drawing Figures

METHOD AND APPARATUS FOR IMPROVING ELECTROPLATING AND PAINTING RACKS

FIELD OF THE INVENTION

The invention relates to an improved method for constructing racks for supporting objects during processing and to the specific apparatus of the improved racks.

BACKGROUND OF THE INVENTION

Fixtures of the type used, for example, in the fields of painting and electroplating represent a major investment for businesses that engage in the painting or electroplating of objects. It has heretofore been necessary to fabricate the fixtures or racks, as they are called in the art, to meet the precise physical support requirements of the objects or parts to be processed. This "specialization" of rack design is especially cumbersome to the custom paint or electroplating shop of the type which accepts job contracts. Such a shop or business must of necessity not only maintain an extensive inventory of special and general purpose racks, but still must maintan the means, either by in-house fabrication facilities or by purchase, to obtain additional specialty racks or fixtures.

Fixtures heretofore used in electroplating have also had the problem of being inefficiently constructed. The inefficiencies lie in two distinct areas. First there is the inefficiency of welded, brazed or mechanically fastened means for holding the part supporting members to a main conducting bar which is usually made from copper. In a typical construction found in the prior art, copper bars of approximately one-half inch square cross-section (12.5 mm by 12.5 mm) are joined at right angles in a cross shape by drilling and tapping the bars and through bolting at the intersection. The process of drilling and tapping removes a portion of the electrical conduction path of the copper bars causing inefficiencies and non-uniform electrical current distribution in the bars. This also results in less current being transmitted to the parts held in the fixture. Object/part holders, or tips as they are called in the art, are attached to the conducting bars in a similar fashion.

Second is the inefficiency of construction. The labor intensive steps of drilling, tapping or even of brazing the bar intersection joints and tips into the fabricated rack or fixture considerably add to the cost of the final fixture and to the costs which must be charged by the business for electroplating. Even minor modifications of the rack to suit new purposes can be an involved and labor intensive process. Additionally, inventoried racks represent a large amount of copper which is not being efficiently utilized, but which has heretofor been stored with the inventoried racks.

Therefore, there is a need for a method of constructing fixtures or racks in which the bars and tips from which the racks are constructed may be easily connected and disconnected from one another. There is also a need for an apparatus for attaching bars and tips to one another that can be reused. There is also a need for a method and apparatus for constructing electroplating racks in which the conducting bars and tips may be joined together without the removal of, interference with or reduction of the electrical path, while maintaning good electrical contact between the respective bars and tips.

Electroplating racks additionally are subject to being themselves plated. This problem has been solved in the prior art by covering the completely fabricated rack with a plastic or similar coating which is impervious to the electroplating bath and is electrically non-conductive. Unfortunately, the solution of the electroplating bath is often partially lost by being siphoned between the rack and its protective coating by a strong capillary action. This also leads to destruction of the rack as the solution is passed directly over the metal surfaces.

Therefore, there is a need for an apparatus and method for, preventing the initiated of such siphoning by capillary action.

SUMMARY OF THE INVENTION

A primary aspect of the present invention lies in the provision of a retaining tip made of a spring material. The tip has two arms which are joined to one another at one end by a circular wound helical spring of at least 180 degrees, the diameter of the circular winding being small relative to the length of the arms.

Another aspect of the present invention provides a method of utilizing the above described retaining tip in the construction of a rack by placing the circular winding of the circular wound spring around a circular cross-sectioned bar so that the two are in tight contact.

A further aspect of the present invention resides in the provision of object supporting end shapes to the arms of the above described retaining tip, the ends opposite or distal from those at which the arms are joined at the spring. The object supporting ends are configured to the parts or objects to be supported or retained.

Another aspect of the present invention lies in the provision of retaining tips which are easily and quickly removed from the circular cross-sectioned bars of a basic rack or fixture so that different tips may be located at random desired locations on the basic rack.

A further aspect of the present invention resides in the provision of a releasably lockable spring wire for disposition around the protective coating on a rack or fixture for the prevention of establishing capillary flow of electroplating bath solution between the coating and the rack structure.

Another aspect of the present invention lies in the provision of a releasably lockable apparatus for joining two bar members. The apparatus has two arm members which are joined one to the other at one end of each by a circular wound helical spring of at least 180 degrees. The arms are curved or bent in a way to return them to the axis of the helix of the spring. The other ends of the arms, distal from the spring end are configured to releasably and lockably engage one another.

BRIEF DESCRIPTION OF THE DRAWINGS

The best mode contemplated in carrying out this invention is illustrated and better understood by reference to the following detailed description when considered in conjunction with the accompanying drawings and in which.

DESCRIPTION OF THE PREFERRED EMBODIMENT

Figure 2:
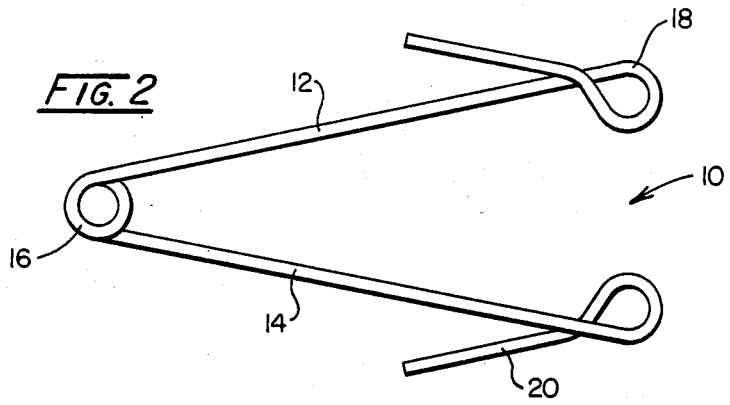
FIG. 2 is a plan view of a retaining tip according to the present invention.

With reference to the drawings, FIG. 2 describes a retaining tip generally shown 10, according to the present invention. An arm 12 is joined to a second arm 14 at one end of each arm by a circular wound helical spring 16. Additionally, each arm 12 and 14 terminates at its other or distal end in an object holding shape 18 and 20. The apparatus 10 is preferably fabricated from a single piece of spring wire by forming the circular wound helical spring 16 at substantially the center of a wire piece. The diameter of the spring winding 16 is small compared to the length of the wire piece. The spring winding must be greater than 180 degrees ($\pi$ radians) since spring is sized to receive a rod by fully surrounding the rod with the spring, as is more fully described below. It is preferably that the spring be formed to be a helix of at least 450 degrees ($5/2\pi$ radians) but less than 540 degrees ($3\pi$ radians), and with additional windings of 360 degrees ($2\pi$ radians) as is necessary to obtain the requisite gripping strength of the spring winding to a rod, as is more fully described below.

The wire from which retaining tip 10 according to the present invention is preferred to be fabricated varies according to the use to which the retaining tip is to put. In the case of electroplating processes, the tip would retain a part or parts to be electroplated in an electroplating bath or solution of the types known to those familiar with the art. A retaining tip for use in electroplating processes should be fabricated from type 302, type 304 or type 316 stainless steels or at least from one of the austenitic stainless steels. Steels having a high carbon content will tend to be subject to hydrogen embrittlement under the conditions of an electroplating conditions and these alloys are to be avoided. However, if the retaining tip is to be utilized in a parts painting fixture or rack, a mild carbon steel having spring properties is acceptable, as for example mild spring steel. It is not a requirement that the wire, from which a retaining tip according to the present invention is fabricted, be of any particular gauge or diameter. The requirement is that the fabricated retaining tip be capable of supporting the object or part for which it has been designed. Typical wire sizes range in diameter from 0.032 inch to 3/16 inch (0.8 mm to 4.8 mm), but greater or smaller diameters may be utilized in the practice of the present invention.

Figure 1:
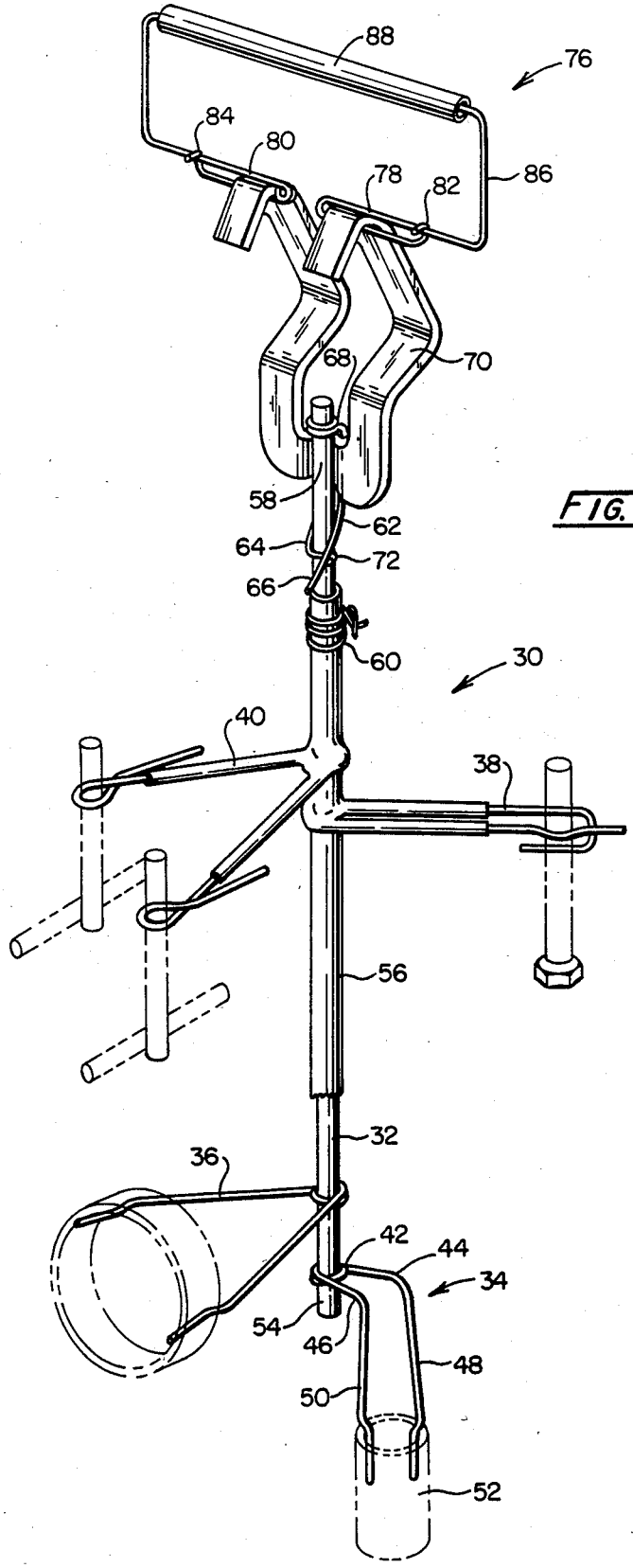
FIG. 1 is a perspective view of an electroplating fixture according to the present invention, in partial cut-away.

With reference to drawing FIG. 1, a fixture 30 according to the present invention is depicted in partial cut-away. Fixture 30 is also uniquely configured for use in holding objects or parts during an electroplating process. A central support rod 32 has retaining tips 34,36,38 and 40 according to the present invention attached to it. Retaining tips 34,36,38 and 40 are substantially similar to retaining tip 10 (FIG. 2) described above, differing primarily in the shape of the object or part holding shape residing at the ends of the arms distal from the circular wound spring. The object holding shape is configured to retain a part for which the tip is designed.

Clearly depicted in FIG. 1 is the means for securing the retaining tip 34 to the central rod 32. It will be understood that all of the retaining tips are attached by the process hereinafter described. The circular wound helical spring 42 joins the two arms 44 and 46 which have also been bent, the object retaining shapes 48,50 beginning at the bend in the arms and continuing to the end of the arms distal from the spring. An object 52 is shown in dotted line to depict the means of object retention. The object retaining shapes vary according to the requirements of the object to be retained and supported by the retaining tip.

Circular wound spring 42 surrounds central rod 32 when it has been properly located as described below. The diameter of circular wound spring 42 when the spring is at rest is less than but substantially the same as that of the rod 32, so that when in place on rod 32, spring 42 firmly grasps rod 32. Spring 42 is placed over rod 32 by "opening" the spring, by which is meant that arms 44 and 46 are grasped and separated such that the circular wound helical spring 42 is slightly unwound by a few degrees thus increasing the diameter of the circular wound spring. The increased diameter circular winding is then placed over the end 54 of central rod 32 and moved the desired distance along central rod 32. Once the proper or desired location on rod 32 has been reached, the arms 44 and 46 are released thus allowing the circular winding to partially relax and firmly grasp the surface of central rod 32. The spring winding is not fully relaxed to its rest position, thereby allowing a residual of grasping force by which the spring engages the rod surface. In this way, tips may be placed and easily moved along central rod 32 to achieve optimal results from the fabricated fixture without removal of any metal or the use of drill and tap connections. In the preferred embodiment, the gripping power of the partially relaxed circular winding around the central rod is sufficient to prevent the retaining tip from even rotating about the axis of the central rod. This is achieved by correlating the at rest diameter of the circular wound spring to the diameter of the rod.

In an electroplating fixture, the tightness of the grip of the circular winding of a retaining tip according to the present invention against the central rod is critical so that proper electrical conduction can be obtained. It will also be recognized that a central rod may also be a series of cross members in a "tree" shape to economize space and to provide other locations for tips on the rod members.

Once a central rod has been provided with the required retaining tips, it is usual in the art of electroplating fixture fabrication to provide a protective coating 56 around the metal parts of the fixture. The protective coating is to protect the metal from the corrosive effects of the electroplating bath or solution, but more importantly is to protect the expensive dissolved metal salts of the bath from being plated onto the fixture rather than the objects desire to be plated. Protective coating 56 is preferrably a vinyl, polyethylene or a polyvinylchloride compound material that may be applied by dip coating in molten plastic. The primary characteristics of the coating are non-electrical conducting and chemical resistance. The preferred material may vary depending upon the chemicals present in the electroplating bath. The coating is then cut-away from the metal at the object retaining shapes of the tips and at the end 58 of the central rod at which it is electrically connected to an electrical power source. In this way a path for electrical current from source to object is established through the fixture. To protect from the loss of electroplating bath or solution by capillary action between the coating 56 and central rod 32 (through the retaining tips), a releasably lockable spring wire 60 is provided around the protective coating 56 at the end of the central rod near the point of connection to the electrical power source. The spring wire 60 is a wire that fully surrounds the protective coating 56 and that is releasably locked by engagement of the wire ends. The wire is tightened in locking so that the wire deforms the protective coating 56 into the surface of central rod 32 thus cutting off any capillary flow of liquids between the coating and the rod it surrounds. In this way no liquid may be lost by this route.

Locking clip 62 is an alternative form of the retaining tip described in FIG. 2 above. Two arm members 64 and 66 have been curved toward and past the axis of the circular winding of spring 68 so as to be able to retain an object between the arms and the rod over which locking clip 62 is utilized. In the example shown in FIG. 1, locking clip 62 is utilized on central rod 32 to retain conductor hanger 70 between arms 64, 66 and central rod 32. The ends of arms 64 and 66 distal from spring 68 have been further configured to engage each other after passing rod 32 the engagement point 72 is releasably lockable for removal of conductor hanger 70 from central rod 32. The locking clip 62 is mounted on central rod 32 in the manner previously described by separating arms 64 and 66.

It should be noted that conductor hanger 70 in an electroplating fixture configuration represents a large amount of the conducting material, usually copper, that is committed to the fixture. By removeably attaching conductor hanger 70 to the balance of the fixture, the conductor hanger may be interchangeably utilized on other fixtures, thereby conserving the amount of copper committed to fixture inventory at an electroplating process and providing the mechanical support for the entire fixture and its contents of arts in the electroplating bath.

Additionally shown in FIG. 1 is a handle 76 which utilizes a friction clips 78 and 80 to tightly engage conductor hanger 70. Friction clips 78 and 80 are releasable by disengaging lock points 82 and 84 respectively. By means of the wire shape 86, the assembly acts as a handle for carrying fixtures from place to place in an electroplating facility. A loosely attached sleeve 88 surrounds wire 86. In this way, one holding a fixture by sleeve 88 is prevented from holding the fixture in any way other than the vertical since the sleeve will allow wire 86 to move according to the weight distribution of the rack.

Figure 3:
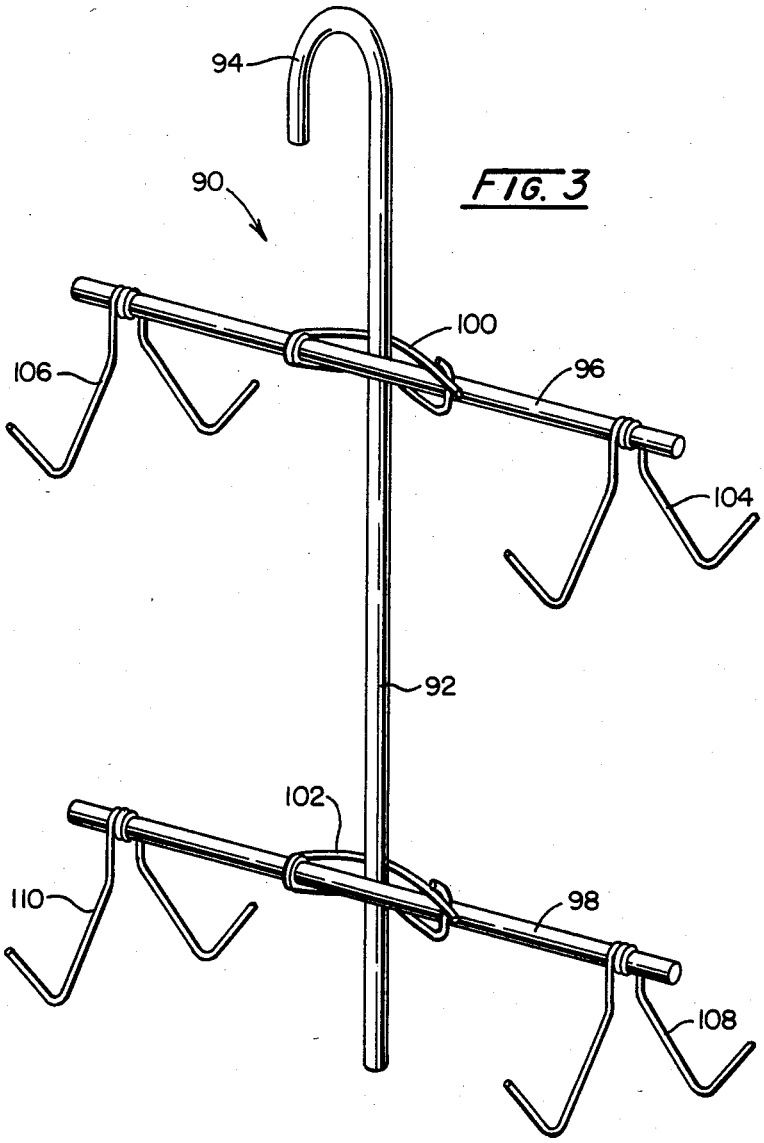
FIG. 3 is a perspective view of an alternative embodiment fixture according to the present invention.

With reference to the drawings, FIG. 3 is an alternative embodiment of a fixture according to the present invention. A fixture 90 such as that shown may be utilized for other purposes than electroplating, as for example in retaining objects to be painted. A central rod 92 has a handle or hanger 94 which is preferrably a simple bend in the central rod. It will be appreciated that a handle 94 may take other forms or even be removably attached as in FIG. 1. Cross members 96 annd 98 are releasably attached to central rod 92 by locking clips 100 and 102 according to the present invention, respectively. Locking clips 100 and 102 are similar in construction to locking clip 62 described in FIG. 1. It will be appreciated that the locking clips may also be utilized with the circular wound helical spring disposed about the central rod.

Retaining tips 104, 106, 108 and 110 according to the present invention are depicted located on cross members 96 and 98. It will be appreciated that the retaining tips are firmly and tightly grasping the surface of the cross members so that they may be rotated initially to positions other than those shown in FIG. 3 and remain in those rotated positions even with the weight of parts or objects hanging from the object retaining ends of the retaining tips. In this way, the object to be, for example, painted may be fixedly oriented in any desired position relative to the fixture for optimal painting and workplace efficiency.

It will be appreciated that numerous changes and modifications may be made in the above-described embodiments of the invention without departing from the scope thereof. Accordingly, the foregoing description is to be construed in an illustrative and not in a limitative sense, the scope of the invention being defined solely by the appended claims.

Having thus described the invention, what is claimed is:

1. A method for making a rack for use in electroplating objects, comprising the steps of:

providing a central support rod of electrically conductive material having a length and a substantially circular cross-section;

disposing on one end of said central support rod means for connection to a D.C. power source;

disposing along the length of said central support rod at least one retaining tip spaced apart from said means for electrical connection, said retaining tip being made of an electrically conductive spring material having two arm members one joined to the other at one end by a circular wound helical spring, the inside rest diameter of the circular wound helical spring being less than the outside diameter of said circular cross-sectioned central support rod, the other end of said arm members bearing support means configured to hold at least one of said objects, said central support rod being disposed within the circular wound helical spring of said retaining tip and being in frictional contact therewith sufficient to prevent said retaining tip from moving relative to said central support rod prior to mounting said objects on said arm member support means, said retaining tips are disposed about said central support rod by moving said arms apart angularly about said helical winding to expand open the inside diameter of said winding sufficient to allow insertion of said rod, when said retaining tip with inside diameter expanded open is located properly along the length of said rod, said arms are released thereby closing said helical winding tightly about said rod, said arms being then angularly displaced relative to their rest positions, said helical spring winding being maintained at a larger inside diameter than said inside rest diameter by the surface of said central support rod, thereby forming an electrical connection between said retaining tip and said central support rod.

2. The method according to claim 1 further comprising the steps of:

mounting objects to be electroplated on said arm member support means.

3. The method according to claim 2 further comprising the steps of:

immersing said central support rod in an electroplating bath to cover said retaining tips and objects to be electroplated.

4. The method according to claim 3 further comprising the steps of:

connecting a D.C. power source to said means for electrical connection disposed on one end of said central support rod, and said electroplating bath to form a D.C. circuit for electroplating said objects.

5. The electroplating rack resulting from the method of claim 1.

6. A method for making a rack for use in painting objects, comprising the steps of:

providing a central support rod of metallic material having a length and a substantially circular cross-section;

disposing on one end of said central support rod means supporting said central support rod during painting of said objects;

disposing along the length of said central support rod at least one retaining tip spaced apart from said means for supporting said central support rod, said retaining tip being made of a metallic spring material having two arm members one joined to the other at one end by a circular wound helical spring, the inside rest diameter of the circular wound helical spring being less than the outside diameter of said circular cross-sectioned central support rod, the other end of said arm members bearing support means configured to hold at least one of said objects, said central support rod being disposed within the circular wound helical spring of said retaining top and being in frictional contact therewith sufficient to prevent said retaining tip from moving relative to said central support rod prior to mounting said objects on said arm member support means, said retaining tips are disposed about said central support rod by moving said arms apart angularly about said helical winding to expand open the inside diameter of said winding sufficient to allow insertion of said rod, when said retaining tip with inside diameter expanded open is located properly along the length of said rod, said arms are released thereby closing said helical winding tightly about said rod, said arms being angularly displaced relative to their rest positions, said helical spring winding being maintained at a larger inside diameter than said inside rest diameter by the surface of said central support rod.

7. The method according to claim 6 further comprising the steps of:

mounting objects to be painted on said arm member support means.

8. The painting rack resulting from the method of claim 6.

* * * * *